US007380967B2

(12) United States Patent
Reed et al.

(10) Patent No.: US 7,380,967 B2
(45) Date of Patent: Jun. 3, 2008

(54) FOLDABLE SUPPORT FOR A DOMED ILLUMINATION ELEMENT

(75) Inventors: Mark C. Reed, West Chester, OH (US); John Delmore Boyer, Lebanon, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 11/279,145

(22) Filed: Apr. 10, 2006

(65) Prior Publication Data

US 2006/0227563 A1 Oct. 12, 2006

Related U.S. Application Data

(60) Provisional application No. 60/670,126, filed on Apr. 11, 2005.

(51) Int. Cl.
*F21V 17/06* (2006.01)

(52) U.S. Cl. ..... 362/433; 362/442; 362/368; 362/408

(58) Field of Classification Search ..... 362/147–148, 362/306–307, 365, 368, 404, 408, 430, 442–443, 362/455–456, 150, 319–320, 296, 277, 346, 362/374, 311, 7, 173, 370, 17; 248/174, 248/346.5; D26/138, 140, 142
See application file for complete search history.

(56) References Cited

U.S. PATENT DOCUMENTS 2,907,873 A * 10/1959 Smith ..... 362/320
3,511,984 A 5/1970 Blaisdell et al.
3,872,296 A * 3/1975 Cohen et al. ..... 362/366
4,375,634 A * 3/1983 Leis ..... 340/472
D269,639 S 7/1983 Eargle, Jr. et al.
4,403,277 A 9/1983 Eargle, Jr. et al.
4,616,293 A * 10/1986 Baliozian ..... 362/7
4,807,089 A * 2/1989 Nussli ..... 362/17
4,943,901 A 7/1990 Baldwin et al.
4,979,084 A * 12/1990 Krauthamer ..... 362/457
D324,113 S 2/1992 Morrison
5,100,445 A * 3/1992 Johnson et al. ..... 55/413
6,024,470 A 2/2000 Wang
6,464,378 B1 * 10/2002 Reed et al. ..... 362/320
6,478,454 B1 * 11/2002 Jaffari et al. ..... 362/307
6,561,676 B1 5/2003 Fischer et al.

* cited by examiner

*Primary Examiner*—Jong-Suk (James) Lee
*Assistant Examiner*—Robert May
(74) *Attorney, Agent, or Firm*—Daniel F. Nesbitt; Hasse & Nesbitt LLC

(57) ABSTRACT

A foldable element support made from planar sheet of material that can be formed by folding into a support for positioning and securing a refractor lens to a luminaire housing. The foldable element support is a planar sheet that has a central base having a central opening, a plurality of foldable securing arms formed into the central base for attaching the support to a luminaire housing, and a plurality of peripherally-arranged support flanges for supporting and positioning the upper rim of the refractor lens in proximity to the luminaire housing. The folded support can be manipulated into the folded configuration by hand, with hand tools, or by a machine.

24 Claims, 10 Drawing Sheets

FOLDABLE SUPPORT FOR A DOMED ILLUMINATION ELEMENT

CROSS REFERENCE TO RELATED APPLICATIONS

The present application claims the benefit of co-pending U.S. provisional patent application 60/670,126, filed Apr. 11, 2005.

BACKGROUND OF THE INVENTION

The present invention pertains generally to a lens support for a luminaire.

A typical luminaire includes a luminaire housing that includes a housing body, a lamp socket, typically a ballast, and electrical circuitry and connections to an electric power source, and an illumination element such as a reflector or a refractor lens to direct light emitted from a lamp inserted into the lamp socket away from the luminaire and toward the illuminated area. The refractor lens typically has a domed shape, having an upper rim that defines an opening, and a lower, larger opening, through which emitted light passes. The refractor lens is positioned and secured to the luminaire housing by a refractor lens support, shown in FIG. 10 and known in the art. The prior art refractor lens support 100 typically has a circular flange 102 that can register with the inner surface of the upper support rim of the refractor lens, and a plurality of arms 104 extending upward from the circular flange that can be secured to the luminaire housing. The refractor lens can be secured to the luminaire housing by positioning the circular flange 102 of the refractor lens support against the inside of the support rim of the refractor lens. The refractor lens support typically has one or more temporary positioning tabs 106 extending from the annular rim 108 that can be manipulated with a machine tool to engage the upper edge of the support rim of the refractor lens, to temporarily fix the prior art refractor lens support 100 to the refractor lens. Once temporarily fixed to the refractor lens, the prior art refractor lens support can be secured to the luminaire housing. The prior art refractor lens support is typically pre-formed in a three-dimensional configuration by machining means well known in the art, with the circular flange curved downward from the annular rim to conform with the inside curved surface of the support rim of the refractor lens, and with the securement arms and temporary positioning tabs directed upward to engage the luminaire housing and the upper edge of the support rim, respectively.

Nevertheless, there remains a need to provide a refractor lens or reflector support that is less expensive and more energy efficient, that can be manufactured and stored more easily and cost effectively, and that does not require a substantial investment in tooling for low- and high-quantity production.

SUMMARY OF THE INVENTION

The present invention relates to a foldable element support made from a planar sheet of material that can be formed by folding into a support for positioning and securing a domed illumination element having an upper opening defined by a support rim and a lower light-emitting opening, to a luminaire housing, the planar sheet comprising: 1) a central base having a central opening; 2) a plurality of peripherally-arranged flange members, each flange member comprising a proximal end extending from the central base, the flange members being foldable into a support flange configuration that engages the support rim of the illumination element; and 3) a means for securing the central base to the luminaire housing.

The present invention also relates to a folded element support for positioning and securing a domed illumination element having an upper opening defined by a support rim and a lower light-emitting opening, to a luminaire housing, the folded element support being formed by folding a planar sheet of material, the folded support comprising: 1) a central base having a central opening; 2) a support flange comprising a plurality of folded, peripherally-arranged flange members that cooperate to engage the support rim of the illumination element; and 3) a means for securing the central base to the luminaire housing.

The present invention further relates to a luminaire assembly for securement to a luminaire housing, comprising a) a domed illumination element having an upper opening defined by a support rim and a lower light-emitting opening, and b) a folded element support for positioning and securing the domed illumination element to the luminaire housing, the folded element support comprising: 1) a central base having a central opening; 2) a support flange comprising a plurality of folded, peripherally-arranged flange members that cooperate to engage the support rim of the domed illumination element; and 3) a means for securing the central base to the luminaire housing.

The present invention provides a refractor lens or reflector support that is less expensive and more energy efficient, that can be manufactured and stored more easily and cost effectively, and that does not require a substantial investment in tooling for low- and high-quantity production.

DETAILED DESCRIPTION OF THE INVENTION

The present invention provides a less expensive and more easily manufactured support for a domed illumination element that can be made by cutting or stamping a foldable pattern out of a planar sheet of material, typically metal. The foldable element support is manufactured in a planar sheet configuration for ease and efficiency of shipping and storage. At the place of manufacture or on the job site where the luminaire will be assembled, the foldable element support can be manipulated into its folded configuration by hand or with a hand tool, to provide positioning and securement of the domed illumination element to the luminaire housing.

Figure 1:
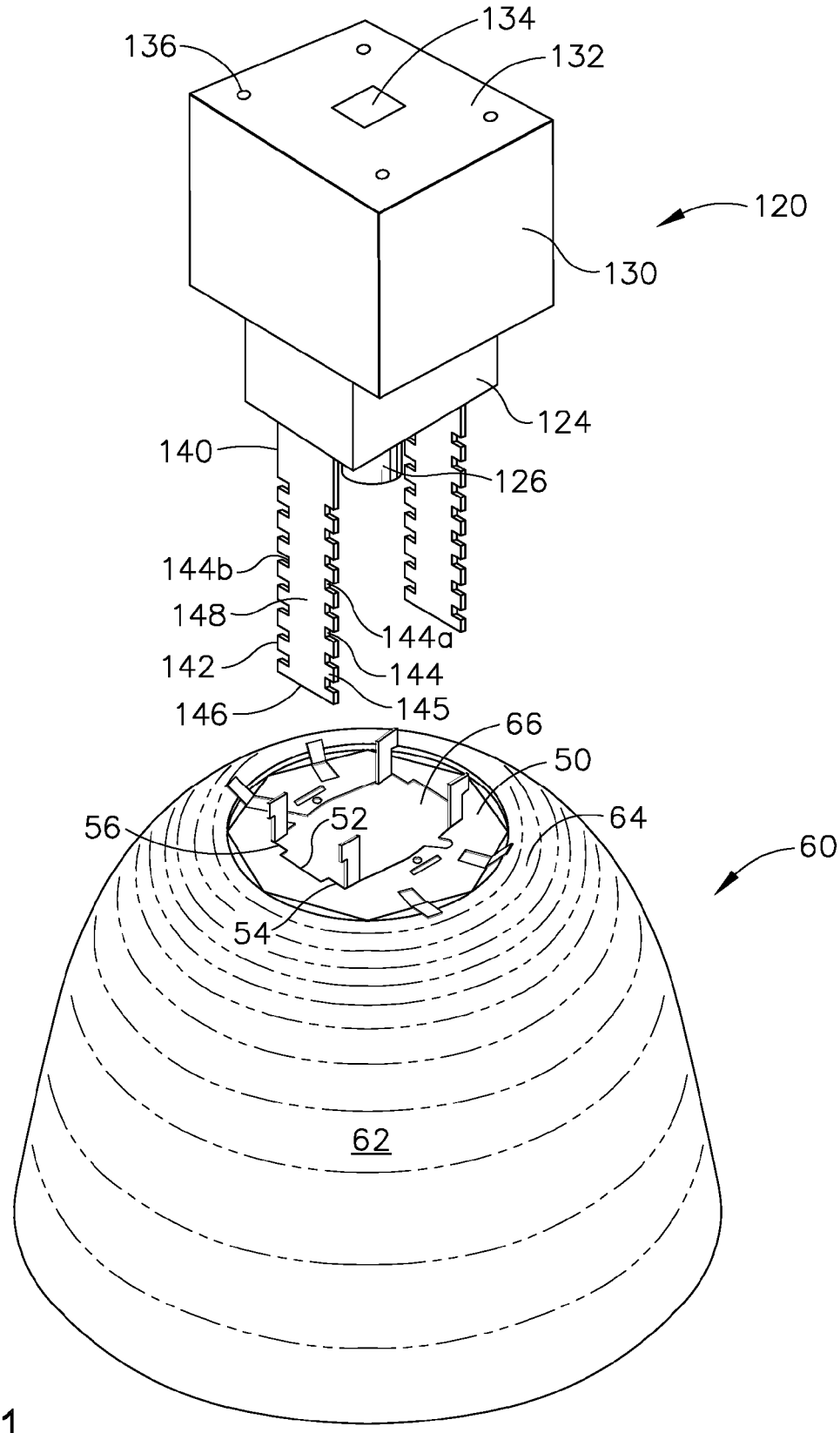
FIG. 1 is a perspective view of a luminaire assembly using a folded element support of the present invention for affixment to a luminaire housing.

FIG. 1 shows a typical luminaire that can employ the folded element support and luminaire assembly of the present invention. The luminaire typically includes a luminaire housing 120 that has a housing body 130 having an attachment surface 132, a ballast 124, a lamp socket 126, and electrical circuitry and connections (not shown) to an electric power source. An illumination assembly 60 of the present invention comprises a domed illumination element 62 such as a reflector or a refractor lens to direct light emitted from a lamp inserted into the lamp socket 126 toward the illuminated area, and the folded support 50 for positioning and securing the domed illumination element 62 to the luminaire housing 120. The attachment surface 132 includes an opening 134 for passage of electrical wiring, and securements 136 for attaching the housing body 130 to a ceiling or other structure.

In a typical embodiment shown in FIG. 1, the domed illumination element 62 is a refractor lens having a domed shape, with an upper support rim 64 that defines an upper opening 66 through which extends the lamp socket 126, and a larger lower opening, through which emitted light passes. The refractor lens is typically transparent or translucent to also refract light emitted by the lamp.

In an alternative embodiment, the domed illumination element comprises a reflector configured to reflect substantially all of the emitted light from the lamp out through the lower opening.

Figure 2:
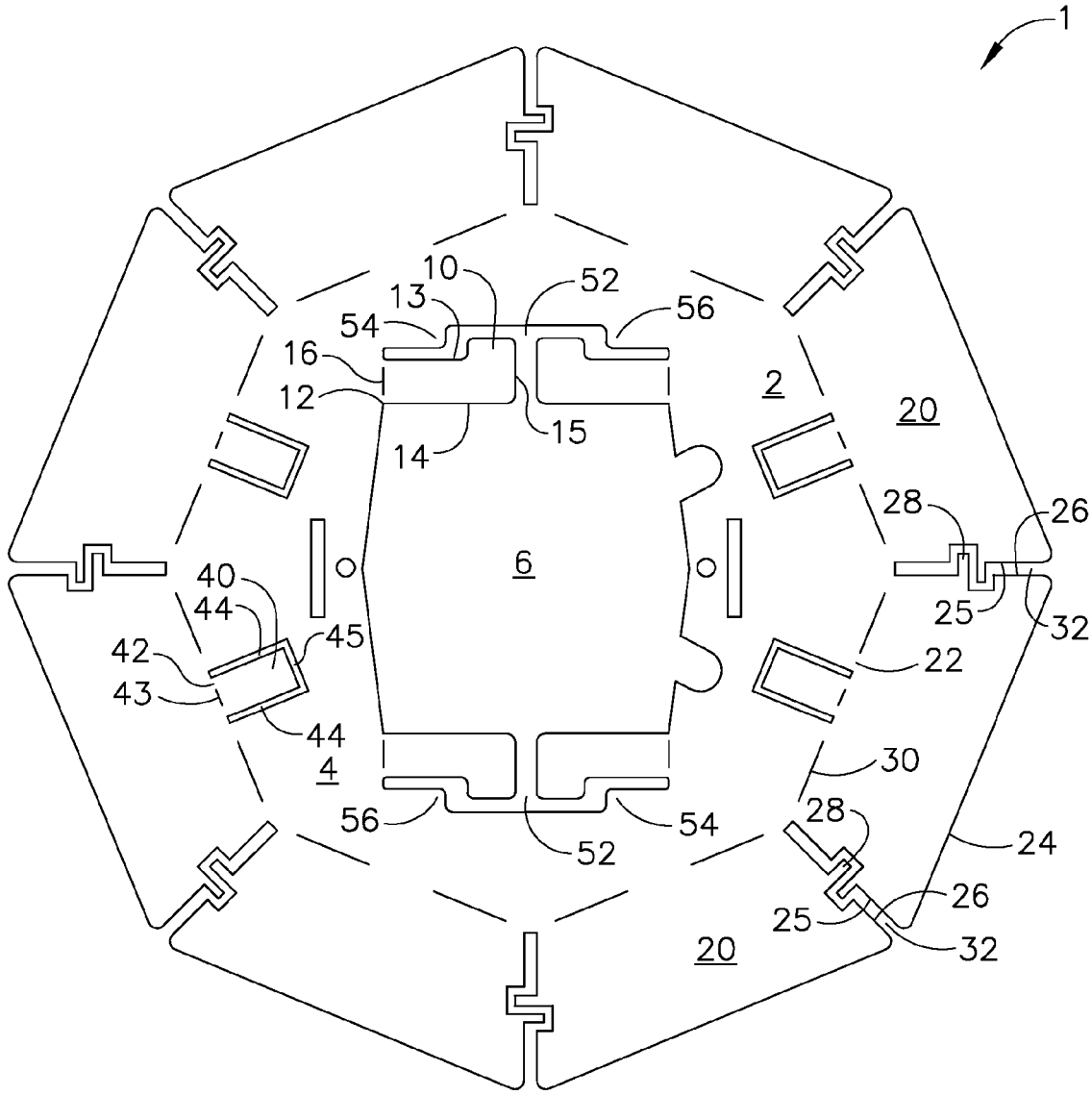
FIG. 2 is a plan view of a foldable element support of the present invention.

FIG. 2 shows the foldable element support of the present invention. The foldable element support 1 is formed from a planar sheet of material 2 of aluminum or other metal, typically by stamping or cutting a pattern into the metal. Cutting of the pattern, openings, and perforations can be made by laser light, stamping, or other means known in the art for cutting shapes and perforations into a metal sheet.

The foldable element support 1 comprises a central base portion 4 having a central opening 6. The central opening 6 is sized sufficiently to accommodate at least the socket 126 (shown in FIG. 1) having internal threads that will later accept the threaded base of a lamp (not shown). The size of the opening 6 is selected to enable the central base 4 to surround the lamp socket 126, to reflect emitted light from the lamp outward from the refractor lens.

A plurality of foldable, peripherally-arranged flange members 20 extend outwardly from the central base 4. Each flange member 20 is associated with the central base 4 along its proximal edge 22, and extends outwardly to a distal edge 24 shown as a linear edge, though the distal edge can be curvilinear as well. Each flange member has a first and second side 25 and 26, respectively, which are disposed proximate to and separated by gaps 32 from the respective second and first sides of adjacent flange members 20. The flange member 20 typically comprises a pre-formed fold line 30 formed along its proximal edge, which can be formed as an impression or score line in the sheet metal, or can be a perforation line or series of perforations through the sheet metal.

Figure 3:
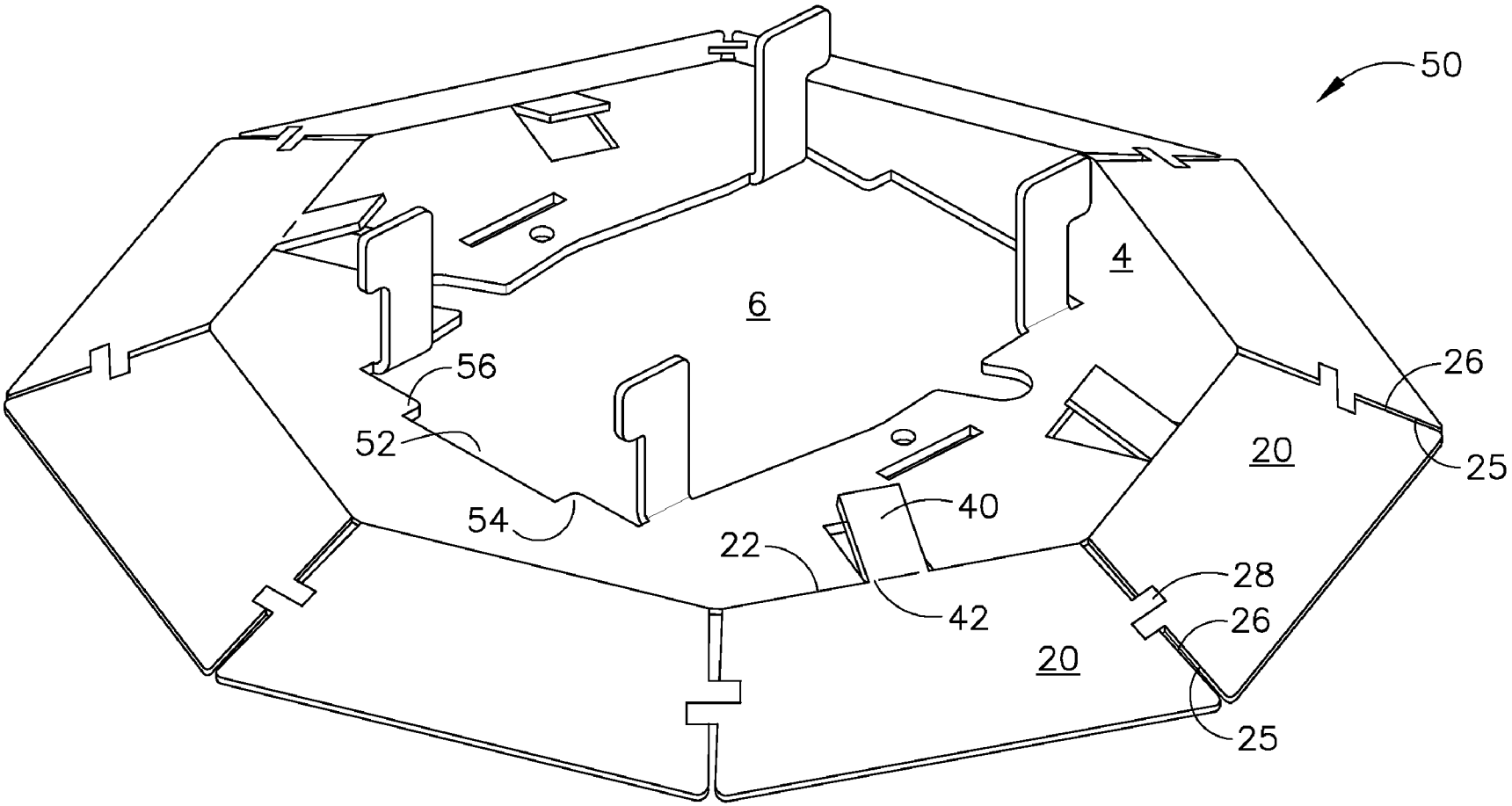
FIG. 3 is a perspective view of a folded element support of the present invention formed by folding the foldable domed element support of FIG. 2.

FIG. 3 shows the lens support 1 after its components have been folded into pre-determined positions to form a folded element support 50. Each of the flange members 20 can be configured into the folded configuration by folding (by hand or with either a hand tool or machine) the flange members 20 along the proximal edge 22 in the same direction (denoted herein as "D" for downward) normal to the plane of the central base 4. In FIG. 2, the respective proximate sides 25 and 26 of adjacent flange members are shown in confronting, abutting position, which can provide cooperative lateral support to prevent any of the flange members 20 from further pivoting beyond the illustrated configuration. In a more typical embodiment, each side edge 25 and 26 can comprise a side positioning tab 28, which can engage the confronting side edge of the adjacent flange member by manipulating the flange members 20, to help lock the flange members together into a unified, peripheral support flange. As shown in FIG. 2, the side positioning tabs 28 can be formed out of the side of the adjacent flange member.

The foldable element support 1 also comprises a means for securing the folded support to the luminaire housing. In the illustrated embodiment shown in FIGS. 2 and 3, the securing means comprises a pair of cut-out recesses 52 on opposite sides of the central opening 6 into which can associate a complementary securement of the luminaire housing 120 (shown in FIG. 1 as the slotted securing arms 140). The recess 52 is formed with a length and depth to accommodate the width and thickness of the central body 148 of the securing arm 140. Shoulders 54 and 56 on opposed ends of the recess 52 fit into a pair of opposed slots 144 in the securing arm 140, and support the tabs 145 that extend outward from the central body 148. This both positions and secures the luminaire assembly to the housing, as later discussed.

The securing means can also include a plurality of foldable securing clips 10 that are formed into the central base 4 by the forming process. Each securing clip 10 has a proximal end 12 by which the clip 10 is joined to the central base 4, and a pair of sides 13 and 14 and a distal end 15 that are free from attachment to the central base. The proximal end of the securing clip 10 can have a pre-formed fold line along its proximate end 12, which can be formed as an impression or score line 16 in the sheet metal, or can be a perforation line or series of perforations through the sheet metal. Each of the securing clips 10 can be configured into the folded affixment position shown in FIG. 3, by folding (by hand or with either a hand tool or machine) along the proximal edge 12 in the same upward direction (denoted herein as "U" for upward) normal to the plane of the sheet metal. The folding of the clip 10 moves them away from the recess 52 so that during the installation of the illumination assembly, the securing arm 140 can be manipulated into its affixed position shown in FIG. 6.

The foldable element support 1 can also optionally comprise a plurality of temporary affixment tabs 40. FIG. 2 shows that the temporary affixment tabs 40 can be formed into the central base 4 by the forming process. Each temporary affixment tab 40 has a proximal end 42 by which the tab 40 is joined to the central base 4, and a pair of sides 44 and a distal end 45 that are free from attachment to the central base. The proximal end 42 of the tab 40 can have a pre-formed fold line 43 along its proximate end 42, which can be formed as an impression or score line in the sheet metal, or can be a perforation line or series of perforations through the sheet metal. Each of the temporary affixment tabs 40 can be configured into the folded configuration shown in FIG. 3, by folding (by hand or with either a hand tool or machine) the tabs 40 along the proximal edge 42 in the upward direction.

Figure 4:
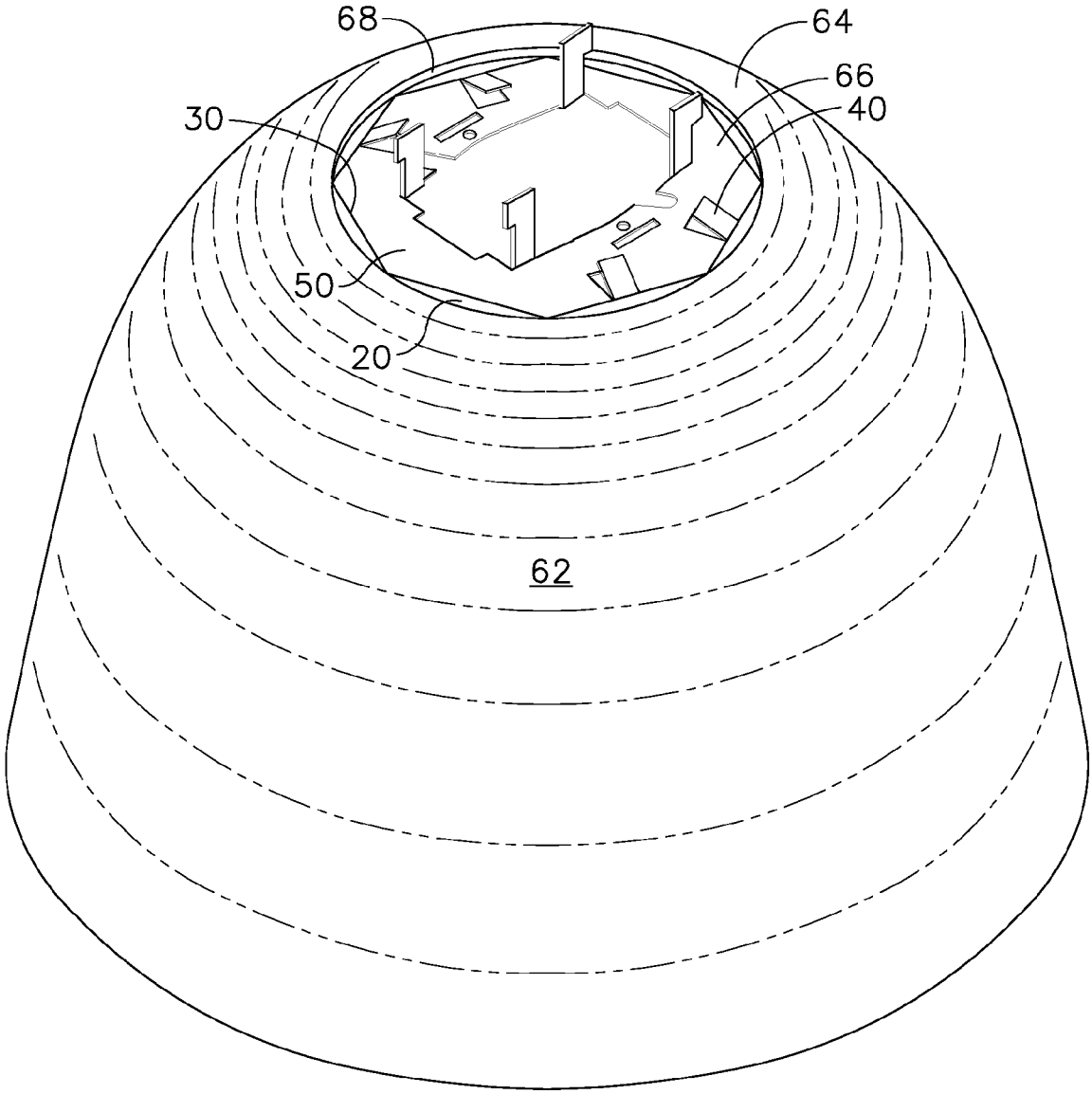
FIG. 4 is a perspective view of the folded element support of FIG. 3 positioned within a refractor lens.
Figure 5:
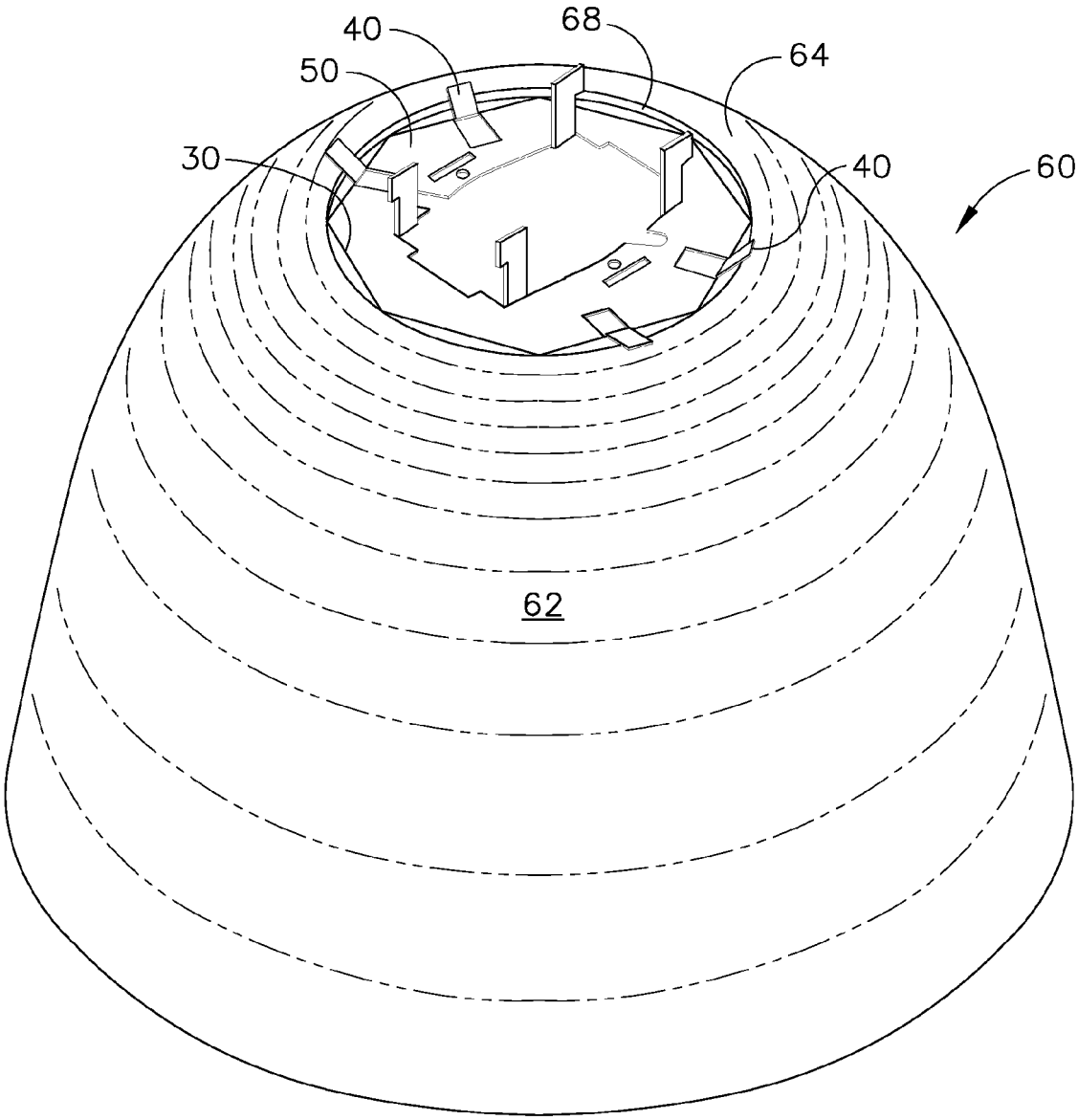
FIG. 5 is a perspective view of a luminaire assembly of the present invention including the folded element support positioned against and temporarily affixed to the support rim of the refractor lens.

Use of the foldable element support to form a folded element support, and the use of the formed element support to position, affix and secure an illumination element to a luminaire housing will be illustrated. First, a foldable element support 1 is taken by a technician who will install the luminaire, and with hands or a hand tool, the flange members are all folded along downward along the pre-formed fold line into a support flange 50. Any optional affixment tabs or securing clips are also folded out of the plane of the central base 4, as illustrated in FIG. 4. The formed support 50 is then placed against the inner surface of the support rim 64 of the refractor lens 62 proximate its upper opening 66, with the pre-formed fold lines 30 of the flange members 20 are positioned along the outer edge 68 of the support rim 64. As shown in FIG. 5, with the folded element support 50 placed in a generally centered position proximate the upper opening of the refractor lens 62, the temporary affixment tabs 40 can be folded upward and backward against the edge 68 of the support rim 64 to temporarily affix the folded support 50 to the support rim 64 of the refractor lens 62, to form the illumination assembly 60.

The illumination assembly 60 is positioned as shown in FIG. 1 for securement to the luminaire housing 120. The luminaire housing 120 has a pair of securing arms 140 that are configured to be engaged with the folded element support 50, for positioning, affixing, and securing the illumination assembly 60 to the luminaire housing. Each securing arm 140 has numerous pairs of laterally-disposed slots 144 formed along each length edge 142. One pair of laterally disposed slots is labeled as 144*a* and 144*b*. The two securing arms 140 are typically formed from a resilient sheet of metal, typically stainless steel.

Figure 6:
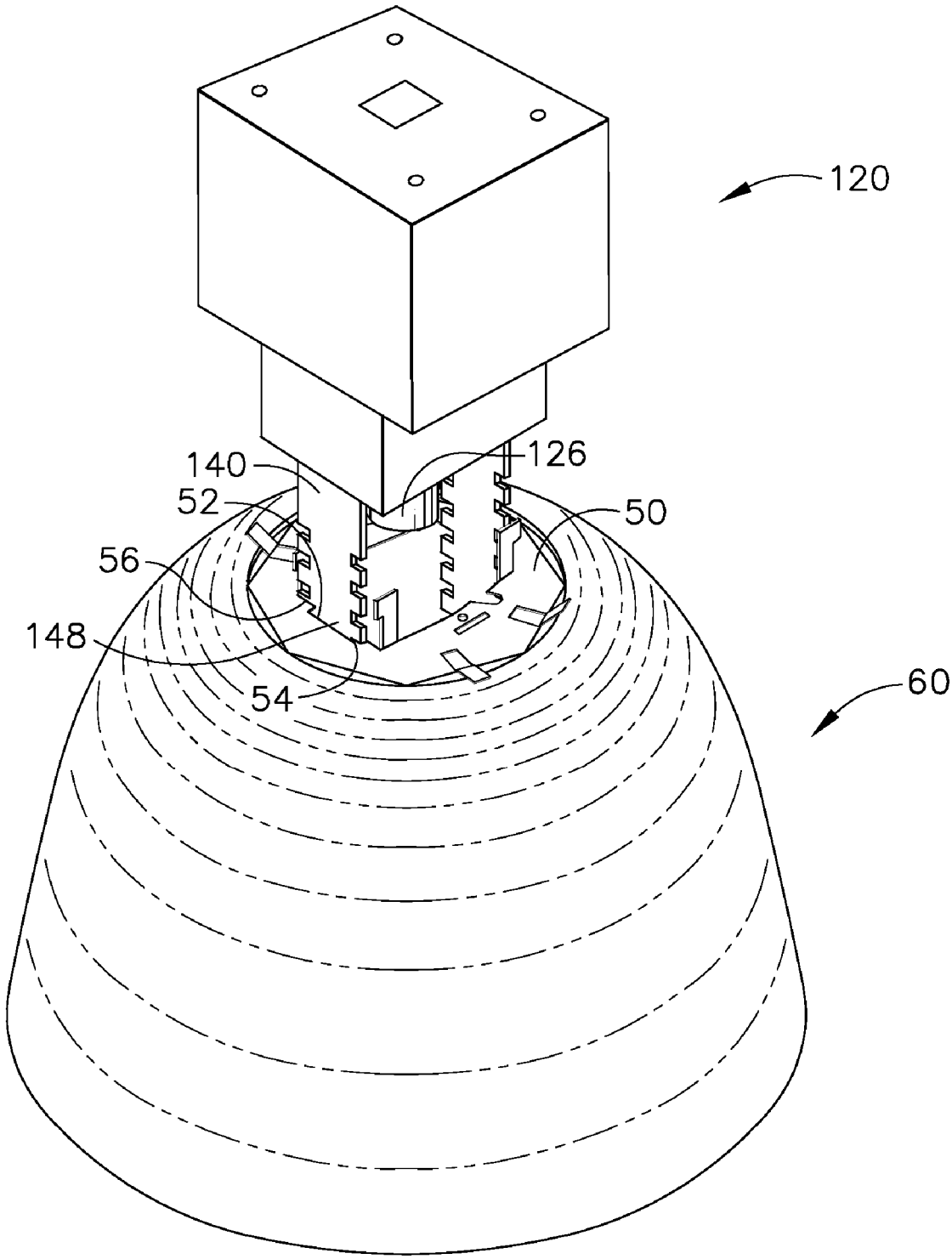
FIG. 6 is a perspective view of the luminaire assembly of FIG. 1 affixed to the luminaire housing.

Referring to FIG. 6, the distal ends 146 of the securing arms 140 are pinched inward toward one another, to allow the distal ends 146 to pass downward through the central opening 6 of the folded support 50. With a selected pair of laterally-disposed slots 144 aligned with the shoulders 54 and 56 of the central base 4, the securing arms 140 can be released to bias outward, so that the shoulders 54 and 56 can pass into the pair of slots 144. The central body 148 portion between the laterally-disposed slots 144 becomes disposed within the recessed slot 52 to affix the illumination assembly 60 to the luminaire housing 120. The pairs of slots 144 along the length of the securing arms 140 provide a means for adjusting the positioning axially (upward and downward) of the refractor lens 62 relative to the luminaire housing 120, and in particular to the socket 126, for precisely positioning a threaded lamp within the refractor lens 62.

Figure 7:
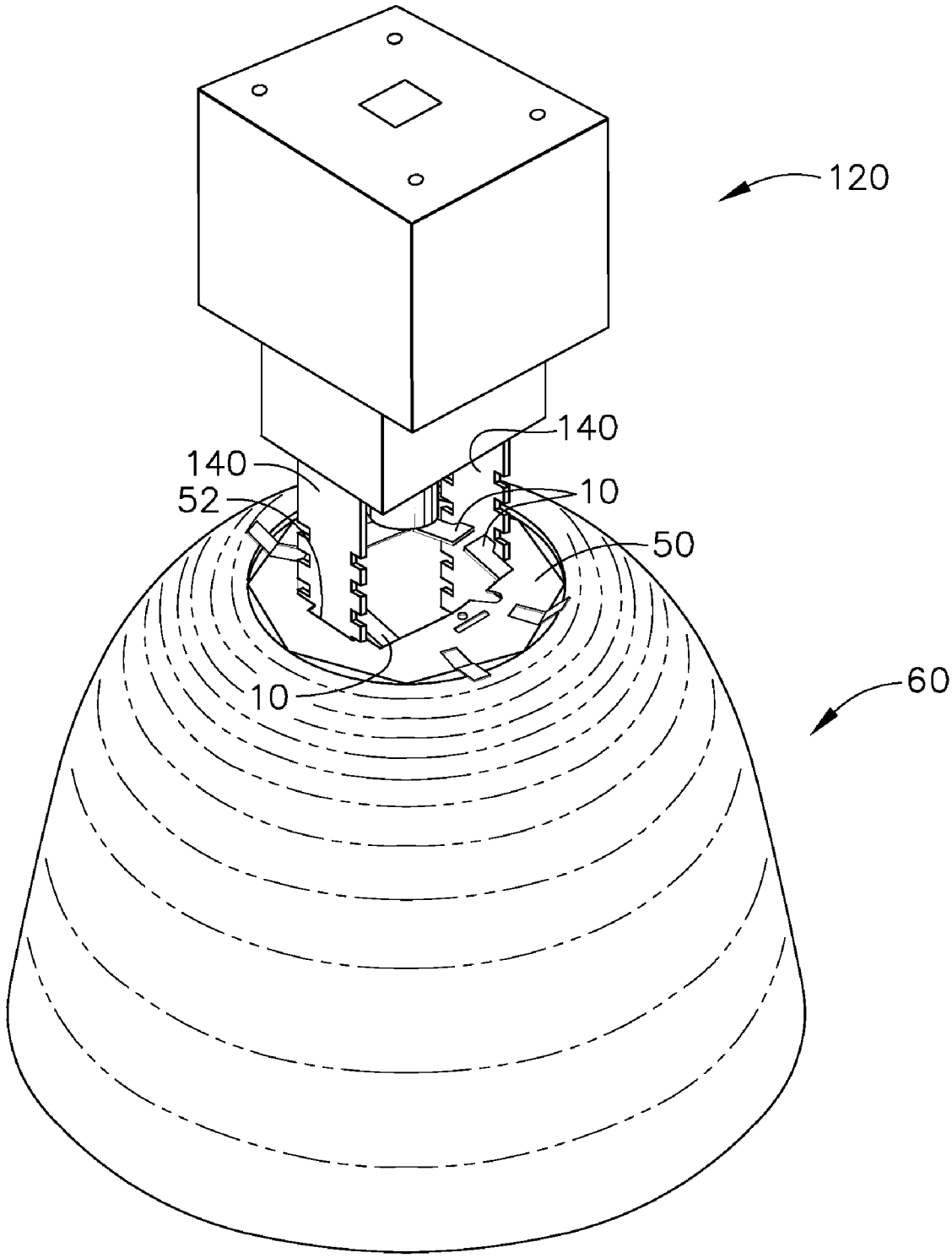
FIG. 7 is a perspective view of the luminaire assembly of FIG. 6 affixed and secured to the luminaire housing.

Referring to FIG. 7, the securing arms 140 can then be secured in position by folding the securing clips 10 downward and inward behind the securing arms 140 to prevent disengagement of the securing arms 140 from the recesses 52, thereby completing the installation of the illumination assembly.

A preferred embodiment of the foldable support 1 comprises at least one highly reflective surface, on the downward-facing surface of the sheet 2, which can improve the reflectance of the emitted light away from both the central base 4 and the flange members 20 during use. The highly reflective surface can be obtained by use of a metal sheet having the desired reflective properties, or by applying a reflective paint or metallized coating to the surface. The highly reflective surface improves the electrical efficiency of the luminaire, and reduces the amount of heat and incidental damage to the acrylic or other plastic material along the rim 64 of the refractor lens, due to the proximity of the lamp.

A variety of securing means known to persons of ordinary skill in the art can be used with the present invention, and include elements that can be formed integrally from the sheet of the central base, or can be separate components that can be conventionally affixed to the folded support, with screws, bolts, adhesives, mechanical engagement, and others.

Figure 8:
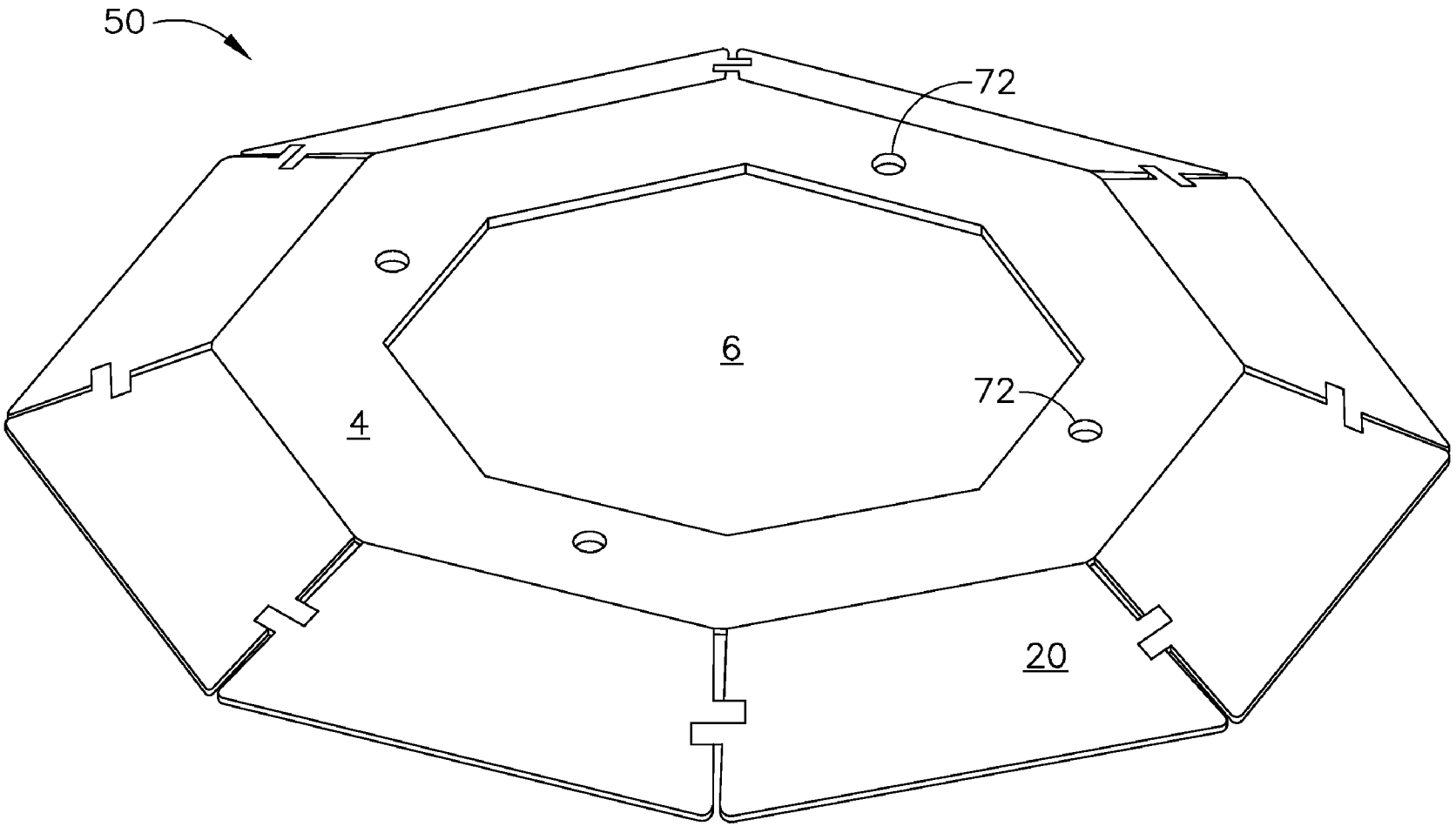
FIG. 8 is a perspective view of an alternative embodiment of the folded support, have apertures for securement to the luminaire housing.
Figure 9:
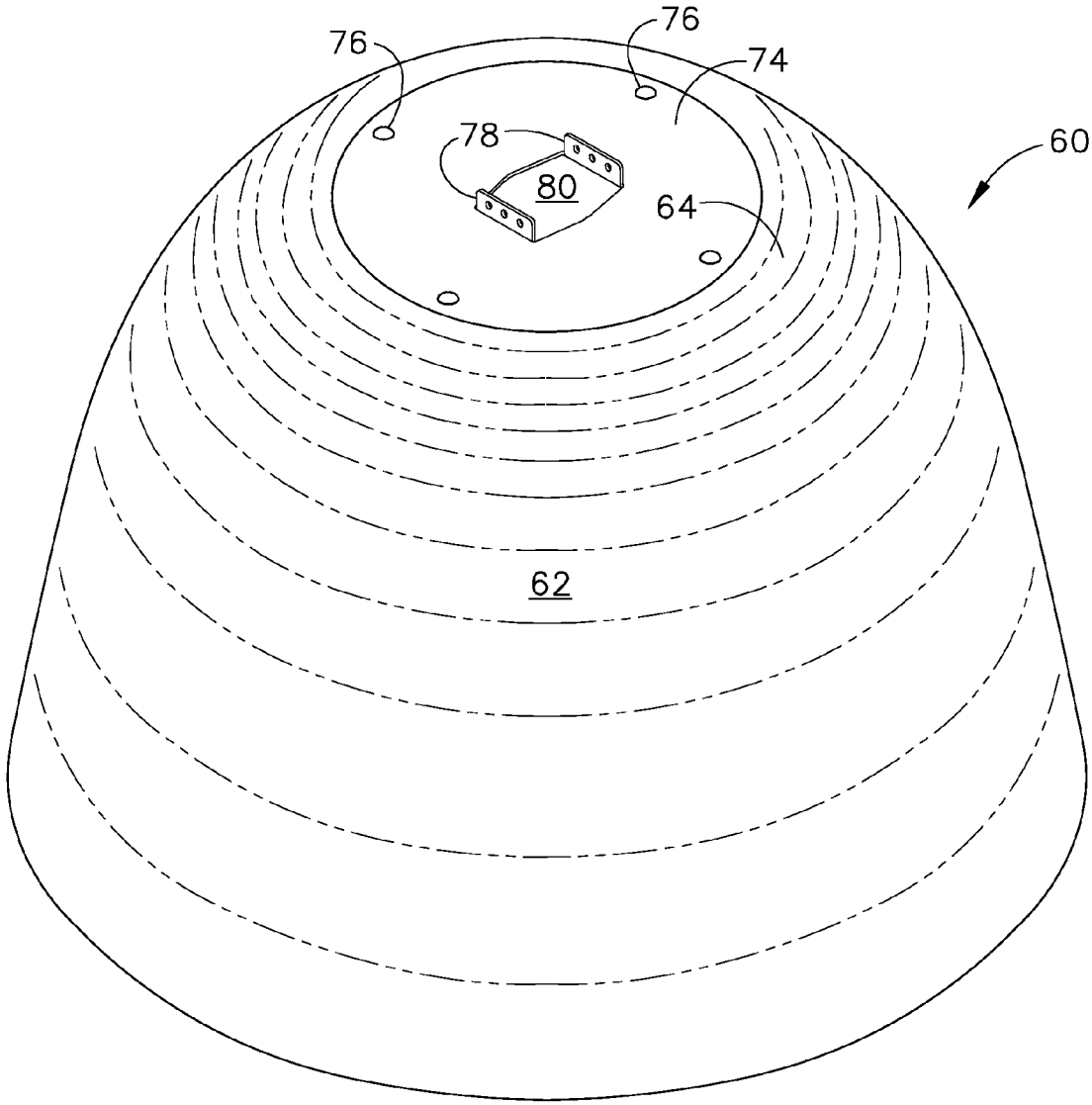
FIG. 9 is a perspective view of the luminaire assembly having a separate component affixed to the folded support of FIG. 8 for securing the luminaire assembly to the luminaire housing.
Figure 10:
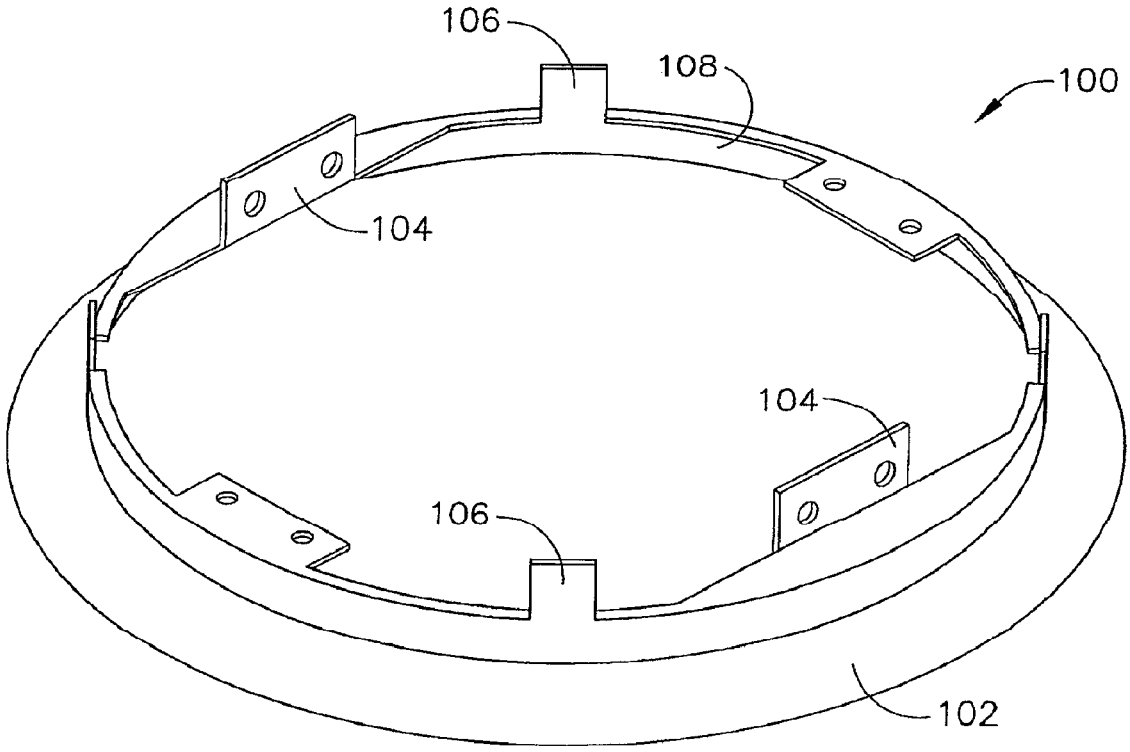
FIG. 10 (prior art)
FIG. 10 is a perspective view of a prior art refractor lens support.

As shown in FIGS. 8 and 9, an alternative embodiment of the folded support 50 can employ a separate component 74 as a securing means that secures indirectly the folded support 50 to the luminaire housing 120. The securing means of the folded support 50 is shown as a plurality of apertures 72 formed through the central base 4. The apertures can be plain holes or threaded holes, through which a fastening screw or bolt can be attached. The folded support 50, when positioned against the support rim 64 of the domed refractor lens 62, is then secured to a separate support bracket 74 as shown in FIG. 9, using a plurality of fasteners 76 (such as screws or bolts), to sandwich and secure the support rim 64 between the support flange of the folded support 50 (not shown) and the separate support bracket 74, to form the illumination assembly 60. The separate support bracket 74 typically has an opening 80, through which the lamp socket 126 of the luminaire housing can pass, and one or more means of affixment and securement of the illumination assembly 60 to the luminaire housing 120, shown as support arms 78.

While the present invention has been illustrated by description of embodiments that has been described in detail, the invention as claimed in the appended claims is not restricted or in any way limited to the scope of such detail.

We claim:

1. A foldable element support consisting essentially of a planar sheet of material that can be manipulated into a folded configuration by hand or with a hand tool to form a support for positioning, supporting and securing a separate domed illumination element having an upper opening defined by a support rim and a lower light-emitting opening, to a separate luminaire housing, the planar sheet comprising:

(a) a planar central base having a central opening and a periphery;

(b) a plurality of peripherally-arranged planar flange members, each flange member comprising a proximal end affixed to and extending from the central base, a lateral distal end spaced apart from the proximal end by a length, and a first and second opposed side edges spaced apart at the distal end by a width that is greater than the length, wherein a first flange member is positioned adjacent a second flange member along the periphery, wherein a first side edge on the first flange member is spaced apart from a second side edge of the adjacent second flange member, wherein the plurality of planar flange members being foldable out of the plane of the central base at a pre-formed fold line disposed along the proximal end, to an angled position wherein the first side edge of the first flange member can abut the second side edge of the second flange members;

(c) a means for securing the central base to the separate luminaire housing; and (d) a plurality of temporary affixment tabs formed into the central base, having a proximal end secured proximate the proximal of a flange member, and having opposed side edges and a distal end that is disposed within, and free from attachment to, the central base wherein the temporary affixment tab is foldable against the edge of the support rim to temporarily affix the foldable element support to the support rim during installation of the separate domed illumination element to the separate luminaire housing.

2. The foldable element support according to claim 1 wherein the pre-formed fold line is at least one linear perforation through the material along the proximal end.

3. The foldable element support according to claim 1 wherein the central base has a substantially round periphery, and wherein the plurality of flange members are arranged around substantially the entire periphery of the central base and are in the same plane as the central base.

4. The foldable element support according to claim 3 wherein the securing means is configured for adjusting the positioning axially the separate domed illumination element relative to the separate luminaire housing.

5. The foldable element support according to claim 3 wherein the flange member comprises a flange positioning tab disposed along the side edge.

6. The foldable element support according to claim 3 wherein at least one surface of the planar sheet of material comprises a reflective coating.

7. The foldable element support according to claim 6 wherein the planar sheet comprises a highly reflective surface.

8. The foldable element support according to claim 3 wherein the means for securing comprises a pair of opposed recesses in the central base, to engage slots in a corresponding pair of securing arms.

9. The foldable element support according to claim 3 wherein the means for securing comprises a separate component that is configured to be fastened to the central base of the folded element, and which comprises a means that can be affixed to the separate luminaire housing.

10. A folded element support for positioning, supporting and securing a separate domed illumination element having an upper opening defined by a support rim and a lower light-emitting opening, to a separate luminaire housing, the folded element support being formed by folding a planar sheet of material, the folded support comprising: (a) a planar central base having a central opening and a periphery; (b) a support flange extending outwardly from the periphery of the central base and out of the plane of the central base, and comprising a plurality of folded, flange members arranged peripherally around the central base, each planar flange member attached to the central base along a proximal end at a pre-formed fold line, and having a distal end spaced apart from the proximal end by a length, and having a first side and opposed second side that abut the corresponding second and first sides of the adjacent planar flange members, wherein the first and second side edges are spaced apart at the distal end by a width that is greater than the length; (c) a means for securing the central base to the separate luminaire housing, and (d) a plurality of temporary affixment tabs formed into the central base, having a proximal end secured to the central base and having opposed side edges and a distal end free from attachment to the central base wherein the temporary affixment tab is foldable against the edge of the support rim to temporarily affix the foldable element support to the support rim during installation of the separate domed illumination element to the separate luminaire housing.

11. The folded support according to claim 10 wherein the flange member has a positioning tab disposed along at least one of the first and second side edges.

12. The folded support according to claim 10 wherein the planar sheet comprises a highly reflective surface.

13. The folded support according to claim 10 wherein the securing means comprises a means for adjusting the positioning axially the separate domed illumination element relative to the separate luminaire housing.

14. The folded support according to claim 10 wherein the means for securing comprises a separate component that is configured to be fastened to the central base of the folded element support, and which comprises a means that can be affixed to the separate luminaire housing.

15. The folded element support according to claim 10 wherein the planar sheet can be manipulated into the folded configuration by hand or with a hand tool.

16. An illumination assembly for securement to a separate luminaire housing, comprising a) a domed illumination element having an upper opening defined by a support rim and a lower light-emitting opening, and b) a folded element support for positioning and securing the illumination assembly to the separate luminaire housing, the folded support comprising:

(a) a central base having a central opening;

(b) a support flange formed by manipulating by hand or with a hand tool a plurality of flange members that are arranged peripherally around the central base, wherein at least a first and second of the plurality of flange members are formed out of the plane of the central base and in side-by-side position wherein a first side of the first flange member engages a second side of the second flange member, and wherein the support flange engages only the inner surface of the support rim of the domed illumination element; and (c) a means for securing the central base to the separate luminaire housing.

17. The illumination assembly according to claim 16 wherein the securing means comprises a means for adjusting the positioning axially of the refractor lens relative to the separate luminaire housing.

18. The illumination assembly according to claim 16 wherein the central base has a substantially round periphery, and wherein the plurality of flange members are arranged around substantially the entire periphery of the central base.

19. The illumination assembly according to claim 18 wherein the folded flange member comprises a positioning tab disposed along the side edge.

20. The illumination assembly according to claim 18 wherein the domed illumination element is a refractor lens.

21. A method of positioning and supporting a domed illumination element to a luminaire housing, comprising the steps of:

(1) providing a separate luminaire housing attached to a ceiling or other structure, and a separate domed illumination element having an upper support rim that defines an upper opening and a lower light-emitting opening;

(2) providing a foldable element support, made from a planar sheet of material and that can be manipulated into a folded configuration by hand or with a hand tool to form a folded element support, the planar sheet comprising: a) a central base having a central opening; b) a plurality of adjacently-disposed flange members, each flange member comprising a proximal end affixed to and extending from the central base, a lateral distal end, and first and second opposed side edges, each of the flange members being foldable out of the plane of the central base wherein the first and second side edges of one flange member can engage the second and first side edges of the respective adjacent flange members, so as to form a peripheral support flange that engages only the inner surface of the support rim of the separate domed illumination element; and c) a means for securing the central base to the separate luminaire housing;

(3) manipulating the plurality of peripherally arranged flange members on the planar sheet of material, by hand or with a hand tool, into the folded element support, the folded element support comprising: a) the central base; b) a support flange comprising the plurality of folded, peripherally-arranged flange members extending from the central base; and c) the means for securing the central base to the separate luminaire housing;

(4) placing the folded element support against the inner surface of the upper support rim of the separate domed illumination element, wherein the support flange engages the support rim of the separate domed illumination element; and (5) securing the central base of the folded element support to the separate luminaire housing.

22. The method according to claim 21 wherein the central base of the provided foldable element support has a substantially round periphery, and wherein the plurality of flange members are arranged around substantially the entire periphery of the central base.

23. The method according to claim 22 wherein the provided foldable element support further comprises a plurality of temporary affixment tabs formed into the central base, each tab having a proximal end that joins the temporary affixment tab to the central base, and a distal end free from attachment, and further comprising the step, after step (4), of folding the temporary affixment tabs against the upper support rim to temporarily secure the folded element support to the separate domed illumination element.

24. The illumination assembly according to claim 22 wherein the domed illumination element is a refractor lens.

* * * * *